US009943880B2

(12) United States Patent
Dorf

(10) Patent No.: US 9,943,880 B2
(45) Date of Patent: Apr. 17, 2018

(54) COLOR CUSTOMIZATION OF ARTICLES

(71) Applicant: Yodle Ventures LLC, Rye, NY (US)

(72) Inventor: Jason Dorf, Mamaroneck, NY (US)

(73) Assignee: Yodle Ventures LLC, Rye, NY (US)

( * ) Notice: Subject to any disclaimer, the term of this patent is extended or adjusted under 35 U.S.C. 154(b) by 176 days.

(21) Appl. No.: 15/041,086

(22) Filed: Feb. 11, 2016

(65) Prior Publication Data

US 2017/0232471 A1 Aug. 17, 2017

(51) Int. Cl.

| | |
|---|---|
| ***B05D 5/06*** | (2006.01) |
| ***D06P 5/00*** | (2006.01) |
| ***D06P 5/20*** | (2006.01) |
| ***B05C 1/00*** | (2006.01) |

(52) U.S. Cl.

CPC ..... *B05D 5/06* (2013.01); *B05C 1/00* (2013.01); *B05D 2203/00* (2013.01); *D06P 5/002* (2013.01); *D06P 5/20* (2013.01)

(58) Field of Classification Search

CPC ..... D06P 5/002; D06P 5/20
USPC ..... 427/282, 256
See application file for complete search history.

(56) References Cited

U.S. PATENT DOCUMENTS

| | | | | |
|---|---|---|---|---|
| 1,596,501 A | | 8/1926 | Martin | |
| 2,402,069 A | | 6/1945 | Minnick et al. | |
| 2,577,498 A | | 12/1951 | Applegate | |
| 2,818,803 A | | 1/1958 | Levorson | |
| 3,392,421 A | | 7/1968 | Mathison | |
| 4,045,897 A | | 9/1977 | Gates | |
| 4,343,910 A | | 8/1982 | Busch | |
| 4,427,390 A | | 1/1984 | Manger | |
| 4,477,938 A | | 10/1984 | Rogut | |
| 5,367,734 A | | 11/1994 | Terry | |
| 5,505,739 A | * | 4/1996 | Montesano | D06B 11/0096 26/28 |
| 5,538,515 A | * | 7/1996 | Kafry | D06B 11/0096 8/102 |
| 6,521,000 B1 | * | 2/2003 | McFarland | D06B 11/0096 8/149.1 |
| 6,916,179 B2 | | 7/2005 | Thornton | |
| 6,974,366 B1 | * | 12/2005 | Johnson | B24B 23/02 451/29 |
| 7,014,662 B1 | * | 3/2006 | Mei | D06B 11/0096 8/101 |
| 7,296,301 B1 | | 11/2007 | Conn | |

(Continued)

FOREIGN PATENT DOCUMENTS

| | | |
|---|---|---|
| JP | 2013-241688 A | 12/2013 |
| WO | 2011/153296 A1 | 12/2011 |

(Continued)

OTHER PUBLICATIONS

Mariefriddle, Mariefriddle, N.o. Mar. 10, 2013, https://mariefriddle.com/2013/03/.

(Continued)

*Primary Examiner* — Cachet I Sellman
(74) *Attorney, Agent, or Firm* — Dorf & Nelson LLP; Scott D. Locke

(57) ABSTRACT

Kits and methods are provided for color customization of articles by applying ink to regions of decreased pigment density. By creating tension over these regions during application of the ink, the ink may be preferentially transferred to those regions.

15 Claims, 4 Drawing Sheets

(56) References Cited

U.S. PATENT DOCUMENTS

| | | | | |
|---|---|---|---|---|
| 8,157,949 | B2 * | 4/2012 | Kim | D06Q 1/00 156/277 |
| 2002/0124323 | A1 * | 9/2002 | Cliver | D06P 5/12 8/115.51 |
| 2004/0010856 | A1 * | 1/2004 | McDevitt | D06M 16/003 8/115.51 |
| 2004/0025271 | A1 | 2/2004 | Shimada | |
| 2004/0053562 | A1 | 3/2004 | Petroski et al. | |
| 2005/0000050 | A1 | 1/2005 | Galvin | |
| 2005/0167408 | A1 * | 8/2005 | Gaiotti | A41D 27/08 219/121.68 |
| 2006/0010634 | A1 | 1/2006 | Moser | |
| 2006/0225225 | A1 * | 10/2006 | Bushell | D06B 11/0096 8/115.51 |
| 2006/0230952 | A1 * | 10/2006 | Kim, II | B41F 17/001 101/41 |
| 2007/0254129 | A1 | 11/2007 | Horblitt | |
| 2008/0141441 | A1 * | 6/2008 | Canter | D06P 5/00 2/227 |
| 2010/0162508 | A1 | 7/2010 | Olhe et al. | |
| 2011/0189927 | A1 | 8/2011 | Lipson | |
| 2014/0053348 | A1 * | 2/2014 | Finley | D06P 5/002 8/543 |
| 2016/0346895 | A1 * | 12/2016 | Dorf | B24B 7/20 |

FOREIGN PATENT DOCUMENTS

| | | | |
|---|---|---|---|
| WO | 2014/035817 | A1 | 3/2014 |
| WO | 2016/191336 | A1 | 12/2016 |

OTHER PUBLICATIONS

Adhere_Definition of Adhere by Merriam-Webster, "Adhere." Merriam-Webster. Merriam-Webster, n.d. Web. May 19, 2017.

* cited by examiner

COLOR CUSTOMIZATION OF ARTICLES

FIELD OF THE INVENTION

The present invention relates to the field of customization of clothing, accessories and other articles through the application of color.

BACKGROUND OF THE INVENTION

People like to express their individuality and often do so through the clothes that they wear and the accessories that they select. However, there is an inherent challenge in trying to express one's individuality through mass produced goods. When companies produce and market new articles of clothing or accessories or new styles, the first purchasers and users might stand out, but as those articles become popular, by definition they are no longer expressions of individuality because a large number of people will wear and use them.

One solution that the apparel and accessories industries have found is to offer articles that can be customized by the user. For example, common gifts for young children and tweens are jewelry making kits and key chain making kits. For older persons, also sold in the marketplace are fabric pens and tools for adding jewels or other decorations to clothing, typically denim. Unfortunately, many of these and similar tools are not sufficiently user friendly, particularly for children. Additionally, not all of these technologies satisfactorily allow for the easy addition of one or more colors to express individuality.

Thus, to date the desire for consumers to find new ways to customize their apparel, accessories, and other articles of personal property remains unsatisfied. The present invention addresses this need by providing new, efficient, and user friendly tools, kits and methods for personalizing articles of personal property.

SUMMARY

Various embodiments of the present invention provide one or more of tools, kits and methods for customizing articles through color, including but not limited to apparel, accessories and other goods. A person may use these embodiments to add one or more colors to a first region of an article that is configured, treated or oriented to preferentially receive color as compared to a second region. Through the use of the inventions described herein, one can effectively, efficiently and enjoyably customize articles.

According to a first embodiment, the present invention provides a kit for customizing an article of personal property, wherein the kit comprises: (a) a rubbing template, wherein the rubbing template has a front surface and a back surface, wherein the front surface defines a shape and the back surface has a surface area; (b) a rubbing tool, wherein the rubbing tool comprises an abrasive surface; (c) a mounting sheet, wherein the mounting sheet comprises a first surface and a second surface, wherein the first surface comprises an adhesive material and the first surface has an area that is larger than the surface area of the back surface of the rubbing template; and (d) at least one of an ink pad or an ink stamper.

According to a second embodiment, the present invention provides a method for color customizing an article of personal property, wherein the article comprises fabric (e.g., cotton, denim, wool, nylon, rayon or combination thereof) that has a first region and a second region, wherein the first region has a first density of color element and the second region has a second density of color element, wherein the second density of color element is greater than the first density of color element and the first region is adjacent to the second region, said method comprising applying ink to the first region under conditions in which greater tension exists in the first region than in the second region and in which said ink causes change in the color of the first region, e.g., is retained or absorbed by the first region.

Through the use of the various embodiments of the present invention, one may efficiently and effectively introduce one or more colors to one or more regions of articles, such as articles that are comprised of fabric that has fibers. The various embodiments described herein may be used together to provide an enjoyable way for children and adults to personalize their articles through the introduction of color to personalize the appearance of their articles, e.g., shapes such as designs, slogans and letters that appear on fabric.

These and other tools, kits, methods, features, and advantages of the present invention will be apparent to those skilled in the art from the following detailed description of the embodiments and the drawings.

BRIEF DESCRIPTION OF THE DRAWINGS

The tools, kits and methods disclosed herein and the following detailed description of certain embodiments thereof may be understood by reference to the following figures. Elements in the figures are presented for illustrative purposes, and they are not necessarily drawn to scale.

DETAILED DESCRIPTION

Figure 1:
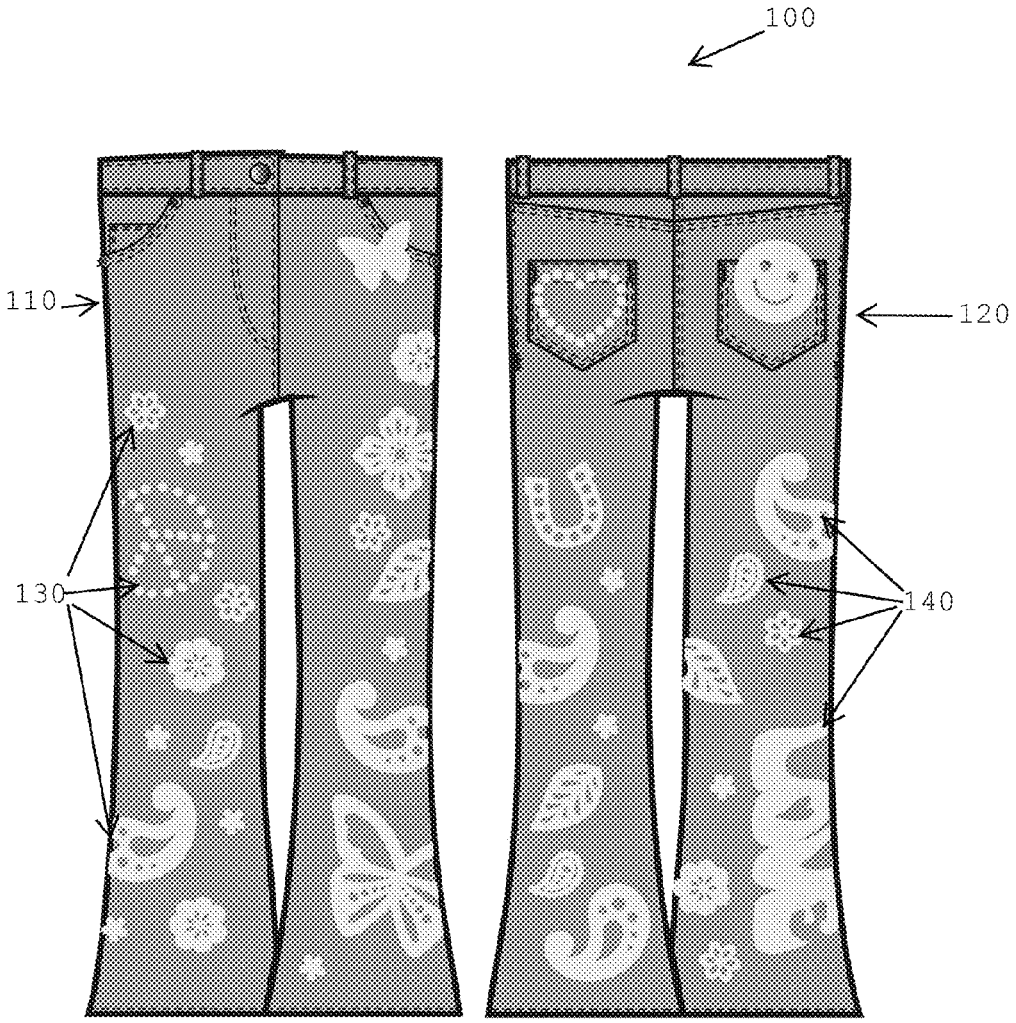
FIG. 1 is a representation of the front and back of a pair of jeans that have been customized.

The present invention will now be described in detail through various illustrative, non-limiting embodiments thereof with reference to the accompanying drawings. The invention may, however, be embodied in many different forms and should not be construed as being limited to the illustrative embodiments set forth herein. Rather, the embodiments are provided so that this disclosure will be thorough and will fully convey the concept of the invention to those skilled in the art.

According to one embodiment, the present invention provides a kit for customizing articles. An article is "customized" when a user introduces his or her style through one or more designs, words, slogans, letters, symbols or representations of real or imaginary objects or other shapes and optionally his or her color choice. The term customized is used interchangeably with the term "personalized." A "kit" refers to a combination of elements that are stored, sold or shipped together. They may, for example, exist in a box, bag, or other container at a point of sale in a brick and mortar or online environment.

The kit comprises a rubbing template, a rubbing tool, a mounting sheet, and at least one of an ink pad or ink stamper.

Optionally, the kit may further contain one or more of a rubbings collector, an article of personal property, and an applicator for ink. The components may be used to transfer a shape to the article efficiently and effectively and then to introduce color to the shape. By transferring the shape, a shape that is the same size as that of a shape on the rubbing template may be caused to appear on the article of personal property; however, no physical part of the rubbing template becomes permanently affixed to or part of the article. Thus, the step of transferring is in effect a means by which to copy the shape through rubbing and displacement of coloring that was previously at a location on the article. What has been transferred and appears on the article may also be referred to as a "rub design." Each of the aforementioned components is described below.

Rubbing Template

The rubbing template is a physical item that has a front surface that defines a shape of interest. The shape is what is to be transferred to the article. In some embodiments, only one surface of the rubbing template defines a shape to be transferred.

In other embodiments, two, three, four, five, six, or more surfaces of the rubbing templates define different shapes that can be transferred at different locations of the same article or at location on one or more other articles.

In some embodiments, there is only one surface that defines a shape to be transferred, and that surface may be referred to as a front surface. The front surface may be flat and it may form the outline of the shape and none of the interior of the shape; or the outline of the shape and some but not all of the interior of the shape; or the outline and the complete interior of the shape. In one embodiment, the front surface forms a relief.

When the front surface defines only the outline of the shape, there may be recesses in the rubbing template between the outline so that when the shape is transferred, the article displays only an outline of that shape. In these embodiments, the rear surface may be solid. Alternatively, when the shape is to form an outline, the interior between the outline over the entire height of the shape may have an absence of material, which renders the rubbing template similar to a cookie cutter with a thick wall. As persons of ordinary skill in the art will recognize, in these cases, the front surface forms the perimeter of the shape. As a person of ordinary skill in the art will also recognize, these gaps, regardless of whether they extend all of the way through the rubbing template will correspond to areas on the article in which color or material is not removed. In some embodiments, the outline is a uniform thickness and, e.g., 2 mm to 10 mm or 3 mm to 8 mm.

When the front surface defines the outline of the shape and only a portion of the interior of the shape, there may be recesses so that when the shape is transferred, the article displays an outline of that shape and certain features that are not along the perimeter of the shape. This allows for more complex designs to be used. On the rubbing template the side that contains the front surface may have depressions between the elements of the first surface so that the back surface remains solid, or the gaps between the regions of the front surface may extend through to the back surface. As a person of ordinary skill in the art will recognize, these gaps, regardless of whether they extend all of the way through the rubbing template will correspond to areas on the article in which color or material is not removed.

In any case in which there are depressions, the distance from the back surface of the rubbing template, which is the surface that is opposite of the front surface may be a first distance and the depressions may be a uniform second distance from the back surface or each depression may be a second distance from the back surface that is not uniform. Alternatively, when the shape is to form an outline, the interior between the outline over the height of the shape is hollow. Thus, in these cases, the front surface forms the perimeter of the shape and the back surface is configured in the same manner.

When the front surface defines the outline and the complete interior of the shape, a solid shape will appear on the article after transfer and the face on which the first surface is located is a uniform distance from the rear surface.

The term "shape" includes but is not limited to a symbol, a letter, a group of letters, a word, a phrase, a number, a representation of an animal, a representation of a person, a representation of a flower, a representation of a tree, a representation or a motor vehicle, a logo or a combination thereof.

Each of the front surface and the rear surface has a surface area. The surface area of the front surface may be smaller than, larger than or the same size as that of the rear surface. In some embodiments, the walls of the rubbing template are all perpendicular to the front surface and the rear surface.

The rubbing template may be made of any material that is sufficiently sturdy that the acts of rubbing and affixing as described in this specification will not destroy its integrity. Further, the material is preferably sufficiently sturdy that it allows for effective transfer of a shape and reuse of the rubbing template. By way of non-limiting examples, the rubbing template may comprise, consist essentially of or consist of rubber, plastic, wood, a laminate material, one or more metals, one or more metal oxides, or a metal alloy, or combinations thereof. In one embodiment, the rubbing template comprises, consists essentially of or consists of rubber and a laminate material and the first surface is rubber and the second surface is the laminate material. When the material is rubber, preferably it is sufficiently sturdy, that rubbing as described herein will not distort its shape.

In some embodiments, none of the surfaces of the rubbing template are adhesive. In other embodiments, the front surface comprises or is associated with a tacky material that allows for reversible adhesion to another surface. When a tacky material is present, preferably it is the selected so that it permits reversible association with the article at a desired location.

In some embodiments, the rubbing template may, for example, be from 2 cm to 30 cm or from 5 cm to 20 cm long; from 2 cm to 30 cm or from 5 cm to 20 cm wide; and from 1 cm to 5 cm or from 2 cm to 4 cm high.

Rubbing Tool

The rubbing tool is designed to rub or scratch off color containing elements of the article. This is accomplished at the locations on the article that are overlain at the highest points on the rubbing template i.e., the front surface. When the article is pulled taut over the rubbing template, those points will have the greatest tension and will either not bend or give in response to being rubbed, or they will do so less than the areas at which there is less tension. Consequently, in these areas in which the highest tension is formed, the rubbing tool will permit removal of color containing elements of the article. By contrast, in other areas, the material of the article will move, fold or crease in response to rubbing, and the rubbing tool will cause no or de minims amounts of the color containing elements to be removed.

In some embodiments, the rubbing tool comprises an abrasive surface. The abrasive surface may, for example, be made of a combination of an elastomeric material and abrasive particles. The abrasive particles may be embedded in and/or disposed upon the surface of the elastomeric material so that a sufficient number of abrasive particles are capable of contacting and abrading the fabric. Examples of elastomers include but are not limited to nitrile, rubber, urethanes such as polyurethane, acrylics, epoxies, polyvinyl chlorides and butadiene rubber. The abrasive particles are preferably rigid and/or granular. Many different types of abrasive particles may be used alone or in combination with one another, including aluminum oxide, silicon carbide, alumina zirconia, diamond, ceria, cubic beron nitride, ganat, ground ceramic particles, ground plastics (i.e., polyvinyl chloride (PVC)), gromid glos and quartz.

The abrasive surface may be located on fewer than all sides of the rubbing tool, e.g., on only one side, which may be referred to as a rubbing face. By way of a non-limiting example, the rubbing tool may be an emery board.

In some embodiments, in addition to an abrasive surface, there may also be a buffing surface. The buffing surface may, for example, also be located on the rubbing face. When both the abrasive surface and the buffing surface are located on the rubbing face, they may, for example, be located on opposite portions of the rubbing face so that a user is able to use exclusively the abrasive surface or the buffing surface at any one time and to switch between them he or she may rotate the device, e.g., 180 degrees. The abrasive surface is designed to permit scratching away of color containing material, whereas the buffing material is designed to slide away the material and to give the appearance of a complete removal.

By way of further example, the rubbing tool may be in the form of a flexible foam block such as a block made from polyurethane that has an abrasive coating. The foam block may be molded or cut into a shape and of a size that renders it suitable for holding by a user in her or his hand. Thus, it may have gripping material, and additionally or alternatively indentations that correspond to places for a user's fingers. Alternatively, in some embodiments it may be rectangular or substantially a 3-D rectangle.

In some embodiments, the rubbing tool may, for example, be approximately 8 cm to 30 cm long, 5 cm to 10 cm side and 1 cm to 4 cm high.

Mounting Sheet

The mounting sheet holds the rubbing template in place. Thus, it is configured to be placed under the material to which the shape of the rubbing template is to be transferred. The mounting sheet may be rigid or flexible or semi-flexible. Preferably when nothing is affixed to the mounting sheet it is flat or substantially flat. In some embodiments, it may be in the form of flexible foam that has a surface with adhesive properties or has been treated with a material to render that surface adhesive.

The mounting sheet may be defined by its first surface and its second surface. The first surface comprises an adhesive material. Within the definition of comprising an adhesive material is the situation in which it is coated with the adhesive material. When not in use, the mounting sheet may have a protective coating or film that rests on the first surface. This protective coating or film may, for example, comprise, consist essentially of or consist of plastic that is capable of being removed from the mounting sheet and leaving the adhesive material capable of adhering to other materials. Preferably, the mounting sheet is designed so that the protective coating or film may be reused on the same mounting sheet to protect the adhesive material from either or both of becoming permanently affixed to another surface and drying out. This additional sheet may be in the form of a peel off adhesive. Regardless of whether there is a peel off adhesive or other protection sheet, the mounting sheet may be designed such that its adhesive is reusable. The advantage of a peel off adhesive that may be reusable is that it prolongs the life of the mounting sheet.

On the side of the mounting sheet that is opposite to the first surface is a second surface. In some embodiments, the second surface comprises or is coated with a material that is not adhesive. By way of a non-limiting example, the second side comprises, consists essentially of or consists of rubber and/or a laminate material. In these embodiments, the second side is non-adhesive and although friction may hold it in place with another surface, no adhesive material is present to cause adhesion.

Preferably, the first surface of the mounting sheet has an area that is larger than the surface area of the back surface and the front surface of the rubbing template. Furthermore, preferably the surface area of the first surface of the mounting sheet is larger than the combined surface areas of the back surface and all of the side surfaces of the rubbing template. In some embodiments, the first surface of the mounting sheet has an area of adhesive material that is at least 5%, at least 10%, at least 20%, at least 30%, at least 40%, at least 50%, or at least 60% larger than the surface area of the back surface of the rubbing template.

By way of a non-limiting example, in some embodiments, the mounting sheet is a regular shape such as a circle, ellipse, oval, triangle square, rectangle with adjacent sides having unequal lengths, or other polygon. In other embodiments, the mounting surface is an irregular shape. For example, it may be circle with a radius of 4 cm to 15 cm or 8 cm to 12 cm. In other non-limiting examples, it may be a square with sides from 5 cm to 30 cm or 10 cm to 20 cm or a rectangle with a length from 5 to 10 cm and a width from 8 to 30 cm. In some embodiments, the mounting sheet has a thickness of 2 mm to 30 mm or 5 mm to 25 mm or 10 mm to 15 mm.

Rubbings Collector

In some embodiments, the present invention comprises a rubbings collector. The rubbings collector is a device that is constructed to collect the rubbings i.e., the material of the article that has been removed through abrasion, thereby leaving the shape. The rubbings collector may have an adhesive surface similar to that of a lint brush. Additionally or alternatively, it may have a magnet, which would be of use should the material that is abraded contain metal.

The rubbings collector may be a separate instrument or it may be configured to be reversibly affixed to the rubbing tool. In some embodiments, the rubbings collector has an adhesive surface that is capable of reversibly adhering to the rubbing tool and the adhesive surface is wider than the rubbing tool.

Additionally or alternatively, in some embodiments, the rubbings collector may have a cut out or be otherwise configured with a region that forms a trough in which at least part of the rubbing tool may rest. The side of the rubbings collector that abuts the rubbing tool may be affixed to the rubbings tool through one or more of clips, snaps, hook and latches e.g., VELCROX®, and an adhesive surface. As persons of ordinary skill in the art will recognize, in each of the aforementioned systems other than the use of an adhesive surface, two elements are used and one must be on the rubbings collector and the other reciprocal element on the rubbing tool. Preferably, the two devices are capable of being reversibly affixed to each other. Thus, each of the rubbing tool and the rubbings collector may be reused after being separated from each other, regardless of whether they are re-associated with each other.

As noted above, the rubbing tool may have an abrasive surface. In various embodiments, preferably, this is not the side that abuts the rubbings collector when the rubbings collector is used.

When the rubbing tool sits within the trough preferably, the rubbings collector is wider than the rubbings tool. For example, it may be 1 to 5 cm wider than the rubbing tool on each side of the rubbing tool. By being wider than the rubbing tool, the rubbings collector can collect rubbings after each movement of the rubbing tool from side to side. In other dimensions, the rubbings collector may be shorter or longer than the length of the rubbing tool and e.g., 0.5 cm to 5 cm thick.

In some embodiments the rubbings collector is configured with a hand-grip or a handle. When there is a handgrip, it may, for example, reside on the back of the trough. When there is a handle, it may, for example, extend from the back side of the trough.

Ink Pad or Ink Stamper

In some embodiments, the kit comprises the ink pad, and optionally an applicator, wherein said applicator is capable of transferring ink from said ink pad to said article. In some embodiments, the ink pad comprises a plurality of different color inks, whereas in other embodiments, an ink pad contains only one color ink. Within a kit, there may be one or more ink pads. The ink pad preferably contains one or more color of ink that may be transferred from the pad to another device, i.e., an applicator. The ink of the ink pay may, for example, be stored in an ink compact and in or on foam or a sponge material. The applicator may, for example, be an emery board or a popsicle stick or tongue depressor.

In some embodiments, the kit comprises one or more ink stampers. In one embodiment, there is a first ink stamper and a second ink stamper, wherein the first ink stamper comprises a first ink and the second ink stamper comprises a second ink, wherein the first ink and the second ink are different colors. An ink stamper may contain ink stored on a foam structure. By using an ink stamper, one may transfer ink directly to another surface by the application of force, and thus, not need to use an applicator.

Instead of an ink stamper or ink pad, in some embodiments, the kit may contain an ink pen such as a fabric ink pen.

Article of Personal Property

The article of personal property is the article to which the color will be transferred. Preferably, it is capable of retaining the design on an area of decreased density of a color element such as a rub design and it may, for example, be a fabric. Prior to use of the present invention, the fabric may have a coloring at a location at which the shape is to be formed. After using the present invention, the coloring in that region of the fabric will have been removed and the shape will be defined by a negative, i.e., an absence of color. The rub design may be created when the fabric is either in the form of an article, for example, a consumer product, or it may be in the form of a sheet or swatch that is to be incorporated into the article.

Fabrics that are capable of retaining a rub design and methods for making those fabrics are described in WO 2014/035817, *Ring Dyed Polymer Treated Materials,* published Mar. 6, 2014; the entire disclosure of this reference is incorporated by reference as if set forth in its entirety. Creation of rub designs is described in commonly owned U.S. patent application Ser. No. 14/722,944, *Methods and Kits for Customizing Articles,* filed May 27, 2015; the entire disclosure of this reference is incorporated by reference as if set forth in its entirety.

Fabrics that may be used to retain a rub design include but are not limited to materials that have been formed from one or both of ring dyed yarn and surface dyed yarn. These materials may be prepared with a dye binding composition that includes a polymer and/or additives that are engineered to provide a minimum or maximum degree of migration to position the composition within or on a fiber surface depending on molecular weight and monomer selection. The polymer is generally applied in an aqueous medium. The polymer can be formulated from a number of monomers in the urethane, guanidine, azetidinium, and vinyl halogen families to form polymer emulsions. The solids added on to the textile substrate can range from 0.5% to 50% or 2.0% to 12.0%). Preferably, the polymer has good film forming properties, is durable under laundering conditions, has the ability to incorporate materials that can provide targeted dyestuff attraction and durability, and/or is capable of fixing the dye in its matrix.

In some embodiments, the dye binding composition comprises a urethane based polymer with a molecular weight ranging from 1,000 to 400,000 g/mole or from 2,000 to 200,000 g/mole. The urethane based polymer may be designed to attract and hold selective dyes. In some embodiments, additional materials may be added. The urethane based polymer, in some embodiments, comprises a polyurethane dispersion.

For dyeing with selective dyes, materials that can attract targeted dyes within the polymeric matrix may be incorporated into the dye binding composition. In some embodiments, the dye binding composition comprises cellulose esters including cellulose acetate, cellulose propionate, cellulose butyrate, and combinations thereof. In other embodiments, the dye binding composition comprises the polymer and the cellulose ester.

In some embodiments, the dye binding composition is applied to fibers, yarns, fabrics, and garments in concentrations ranging from 0.5%>to 50%>0 solids; however, with greater percent solids come greater expense and greater stiffness. In one embodiment, the percent solids range to be applied to the fibers, yarns, fabrics, or garments is between 2.0 and 12.0% or between 3.0 and 10.0%. Preferably, the dye binding composition, including the percentage of solids in the composition, is specifically engineered to produce a dye binding composition that causes the polymer and/or selective dye to migrate to the surface for use in producing ring dyed yarns and/or surface dyed fabrics.

Yarns and fabrics can be constructed from any of a host of textile fiber, particularly natural fibers including cotton, wool, silk, hemp, flax, or synthetic fibers including polyesters, rayon, acetate, acrylics, nylons (aromatic and aliphatic), modacrylics, spandex, olefins inclusive of super high molecular weight polyethylene, polyethylene, polypropylene, etc., or combinations of two or more of these fibers. In some embodiments, the yarn contains fiber comprised of 100% cotton. In other embodiments, the yarns comprise cotton fibers blended with non-cotton fibers. The blend of fibers, in some embodiments, is at least 50% cotton fibers.

In the case of applying the chemical to yarn, yarns may be coated and the polymer of the dye binding composition dried such that the yarns are not broken from being stuck together after drying. The dye binding composition can be applied to scoured yarn, scoured & bleached yarn, or yarn in its raw state. Each condition provides a different appearance with the raw yarn providing the greatest ring dyed characteristic. Bath concentrations are also different under each condition because of the absorbency of the yarn for the polymer/water mixture; however, targeted solids addition range from 2.0% to 12.0% depending upon the size of the yarn being treated.

Examples of articles of personal property that may be used in connection with various embodiments of the present invention include but are not limited to apparel for dancers, such as, tee shirts, sweatshirts, pants, leggings, shorts and jackets; athletic such as, namely, shirts, pants, jackets, footwear, hats and caps, athletic uniforms; athletic footwear; athletic tops and bottoms for running, exercising, sports activities, sports activities and yoga, exercising, sports activities and yoga; baseball caps and hats; bath slippers; bathing suits; bathrobes; beach footwear; belts; boots; bottoms; bow ties; boxer briefs; briefs; coats; compression garments for athletic or other non-medical use, namely, running, exercising, sports activities and yoga; denim jackets; dresses; ear muffs; footwear; gloves; graphic T-shirts; hats; headwear; hosiery; jackets; jeans; loungewear; mittens; neckwear; pajamas; pants; rainwear; scarves; shoes; shorts; skirts; slippers; sneakers; socks; sports caps and hats; sports jackets; sports jerseys; sports pants; sports shirts; sports vests; sweat bands; sweatshirts; swimwear; tee shirts; tops; underwear; yoga pants; yoga shirts, backpacks; bags for carrying babies' accessories; all-purpose sport bags; athletic bags; backpack straps; bags for sports; beach bags; belt bags and hip bags; book bags; briefcases and attaché cases; bum bags; canvas shopping bags; carry-all bags; carry-on bags; carrying cases; clutch bags; cosmetic bags; cosmetic carrying cases; diaper bags; drawstring bags; duffle bags; fanny packs; fashion handbags; garment bags for travel; sport trolley bags; gym bags; handbags; hiking bags; jewelry pouches; knapsacks; luggage; make-up bags; messenger bags; military duffle bags, garment bags for travel, tote bags, shoulder bags and backpacks; pouches; purses; roll bags; school bags; school book bags; shaving bags; shoulder bags; sports bags; suit bags; toiletry bags; tote bags; travel bags; umbrellas; wallets; decorative ribbons; elastic ribbons; hair accessories, claw clips; hair sticks; jaw clips; nap clips; twisters; scrunchies; hair ribbons; ribbons; and bath mats; carpets and rugs; door mats; floor mats; and wallpaper.

Methods for Customizing Articles Through the Introduction of Rub Designs

Various embodiments of the present invention are directed to a method for customizing an article. In some embodiments, the method begins with affixing a rubbing template to a mounting sheet to form an affixed rubbing template. The affixing may be to an adhesive surface of the mounting sheet. By way of a non-limiting example, one may use a template and the mounting sheet described elsewhere in this specification.

Next, one places the affixed rubbing template to an inside surface of an article at a transfer location. Because the mounting sheet is larger than the rubbing template, a portion of the adhesive surface of the mounting sheet that is not affixed to the rubbing surface may be affixed to the article. Finally, one rubs an outside surface of the article at a location that corresponds to the transfer location.

The rubbing may be performed with a rubbing tool and the rubbing tool may comprise an abrasive surface. By using the abrasive surface, one may displace color material form the article. In some embodiments, the rubbing tool further comprises a buffing surface, act the act of rubbings comprises: (i) rubbing with the abrasive surface; and (ii) rubbing with the buffing surface.

In some embodiments, the rubbing tool is associated with a rubbings collector. The rubbings collector has an adhesive surface that is capable of reversibly adhering to the rubbing tool and the adhesive surface of the rubbings collector is wider than the rubbing tool. When using the rubbings collector, the method further comprises collecting displaced rubbings through adhesion of the displaced rubbings to the adhesive surface.

In some embodiments, the fabric is denim or a denim blend. The denim may be treated on its surface with ink. The fabric may be any color or colors, or combination of colors, e.g., one or more of red, orange, yellow, green, blue, indigo and violet or combinations thereof. After abrasion of a color, e.g., blue in blue jeans, one may see an absence of dye color, e.g., white.

Methods for Introducing Color

In another embodiment, the present invention provides methods for introducing color to an article. According to these methods, one adds color to a first region of an article that preferentially accepts the color as compared to a second region that may be adjacent to the first region. The first region may be created by the afore-described methods for creating rub designs or by any alternative methods that create the condition for the preferential acceptance and retention of color, e.g., a color element such as ink or dye. Thus, these methods may, but are not required to be, used with the methods or kits described elsewhere in this disclosure.

In some embodiments, prior to the introduction of color by a user, an article may be defined by two or more regions that have different densities of color elements, such as pigments or dyes. The density of a color element may also be referred to as the saturation of the fibers or yarns of material, such as denim with a pigment, for example, blue, which is common in blue jeans or another material as described in WO 2014/035817, *Ring Dyed Polymer Treated Materials,* published Mar. 6, 2014. Unless otherwise specified, the term "pigment" refers to a substance that imparts color to or changes color of fibers, yarns or other material.

Thus, by way of an example, there may be a first region and a second region, wherein the first region has a first density of color element and the second region has a second density of color element. In some embodiments, the second density of color element is greater than the first density of color element. By way of example, the first density of color element might be zero and the second density of color element might be non-zero. In other embodiments, the first density of color element is non-zero, but the second density of color element is at least 10% greater, at least 20% greater, at least 30% greater, at least 40% greater, at least 50% greater, at least 60% greater at least 70% greater, at least 80% greater, at least 90% greater, at least twice as dense, at least three times as great, at least four times as great, at least five times as great or at least 10 times as great. When a first region has a non-zero density of color element, in some embodiments the color pigment is the same as that of the second region. As noted above, he phrase "density of color element" refers to the saturation of color, which also may be defined as the concentration of pigment, dye, ink or element that imparts color to a region of the article. The higher the density of the color element, i.e., amount of the color element in an area or locus, the less faded the material will appear.

The differential in density of color element between a first region and a second region may be caused by any method that is now known or that comes to be known and that from reading this disclosure, a person of ordinary skill in the art would appreciate would be of use in practicing the present invention. For example, the differential may be cause by abrading, including the abrading techniques described in this specification or other abrading techniques. Additionally or alternatively, it may be caused by the application of a laser or the use of acid or other chemicals to remove color.

In some embodiments, the first region is adjacent to the second region such that initially there is visual design that is created by the contrast between the regions of higher and lower density of color elements or between the region of no density of a color element and the presence of a color element. The transition between the first region and the second region may be gradual or there may be a clear demarcation. Further, depending on the shape or configuration of a first region, there may be a plurality of non-contiguous second regions that are adjacent to the first region.

To an article (such as any of the article described elsewhere in this specification), one introduces or maintains tension over all or part of the first region. The tension that is introduced (or maintained if there already was tension) is greater than the tension in the second region. Tension over the first region may, e.g., be introduced by maintaining the position of the mounting sheet and rubbing template as described in various embodiments above. As the fabric of the article is pulled taut side to side or among a plurality of sides or in a plurality of directions, the highest surfaces of the rubbing template (which in some embodiments are a uniform height) push the fabric perpendicularly to the fabric's length and width, and thus cause the highest tension to be introduced at the locations that correspond to (i.e., are overlaid on) those highest surfaces of the rubbing template. The second region, which does not have the highest surfaces of the template pushing it forward, is stretched less. Therefore, it has more give, which corresponds to less tension. The tension over the first region reduces or removes any give over that region and in some embodiments, exposes more surface area of the fibers or yarns in the first region than are exposed of fibers or yarns in the second region.

After the differential in tension between the first region and the second region is created or while it is being maintained, one applies ink to the first region under conditions in which said ink is absorbed by the first region. The tension differential will cause the ink to transfer preferentially to the first region upon contact. Further the color element differential may, in some embodiments, cause any added ink or dye that comes into contact with both regions to be more prominently displayed by the first region. Preferably, the transfer causes the ink to be permanently associated with the yarns or fibers of the first region.

In some embodiments no ink is absorbed by the second region. In other embodiments, some ink is absorbed by the second region, but the amount per unit area (as measured under unstretched conditions) is less than the amount of ink that is absorbed by the first region and the difference in the amount absorbed by the first region and the second region causes the first region and the second region to be different colors, provided that the added ink is a different color than the color of the article in the second region prior to its introduction. Thus, if the article was a pair blue jeans, and there were an abraded region, one might introduce, red, yellow, green, indigo, violet, orange, pink, purple or any color other than the color of jeans to the first region under conditions that the abrading region takes on the color of the ink, and the unabraded region does not change region or only changes region to a small degree such that the unabraded region (second region) and the abraded region now inked (first region) display different non-white colors.

In some embodiments, the ink is applied by transfer directly from an ink stamper. The ink stamper may be put in direct contact with the first region. By physically contacting the stamper with the article (an optionally applying pressure) over all or part of the first region, ink will transfer and become absorbed by the fibers. Because of the tension differential and density of color element differential, at the time of contact the ink will preferentially, if not exclusively transfer to the first region as opposed to the second region.

Alternatively, one may use an ink pad and an applicator. The applicator may be a simple device such as an emery board or a popsicle stick or tongue depressor that will retain ink when it comes in contact with the ink pad and may transfer ink when the applicator comes in contact with the article. In some embodiments, the contact comprises one or both of pressure and rubbing.

Optionally, after ink is transferred, heat may be applied over the region to which the ink was applied. The heat may, for example, be in the form of a heat gun, an iron, a heat press or laser. Additionally or alternatively, one may use a chemical fixative. By using one or both of heat and chemicals, the ink can be permanently adhered to the fibers or yarn and thus not be lost during any washing or cleaning process.

The method described above is an illustration in which one color is added to one region of an article. As persons of ordinary skill in the art are aware, the same color could be added to many different regions that contain no color pigment or less color pigment than other regions of an article. Alternatively a plurality of colors could be added to the same region or to two or more regions. Thus, in some embodiments, the article comprises a first region and a second region as described above and further comprises a third region. The third region is adjacent to the second region, and optionally, it is adjacent to first region or not adjacent to the first region. A first ink may be transferred to the first region and a second ink, which is a different color may be transferred to the third region over an area that prior to transfer has a third density of color element, wherein the second density of color element is greater than the third density of color element. Transfer to the third area in performed under conditions in which the third area has greater tension that the second area.

When there is a plurality of regions to which ink is transferred, one may use a plurality of ink pads and applicators or one may use a plurality of ink stampers. In some embodiments, one uses at least one ink stamper and at least one applicator. If one uses a plurality of different color inks from one or more ink pads, and one uses the same applicator, then one should ensure that the ink colors do not mix or do not mix to an undesirable degree on the applicator or on the article. This may be accomplished by cleaning the applicator between uses and/or controlling the regions over which it is used when the inks are being applied.

Furthermore, in some embodiments, one may introduce blending. In doing this, one may apply the first ink to first region and apply a second ink to a third region, wherein the first region and the third region have both increased tension and decreased pigment density relative to the second region and the first region is contiguous with the third region (e.g., are different parts of the same shape or word or symbol). At a location that the two inks are to meet one may apply both colors, rubbing one into or over the other in order to create the desired blend.

As noted above, the method of this section call for using an article that contains two regions with different color element (e.g., pigment or dye) densities. In some embodiments, this color element differential is caused by abrading the article. By way of a non-limiting example, the abrading may be caused by: affixing a rubbing template to a mounting sheet to form an affixed rubbing template, wherein the rubbing template has a front surface and a back surface, wherein the front surface defines a shape and the back surface has a surface area and wherein the mounting sheet comprises a first surface and a second surface, wherein the first surface comprises an adhesive material and the first surface has an area that is larger than the surface area of the back surface of the rubbing template; placing the affixed rubbing template adjacent to an inside surface of the article at a transfer location; and rubbing an outside surface of the article at a location that corresponds to the transfer location.

In other embodiments, one creates the first region by applying a laser to the article.

The ink may be any ink that may adhere to fibers and/or yarns and be transferred to the fibers by the method described herein. In some embodiments, the ink is fabric ink that is machine washable. Ink is an example of a dye, and instead of ink any other dye may be used to introduce color.

Various embodiments of the present invention may be further illustrated by reference to the accompanying figures. FIG. 1 is a representation of the front and back of a pair of jeans 100 that has been customized. The front side of the jeans 110 shows various designs 130 that have been rubbed out of the jeans. The rear side of the jeans 120 also shows various designs 140 that have been rubbed out of the jeans. To each different design one may introduce color according to the methods of the present invention.

Figure 2:
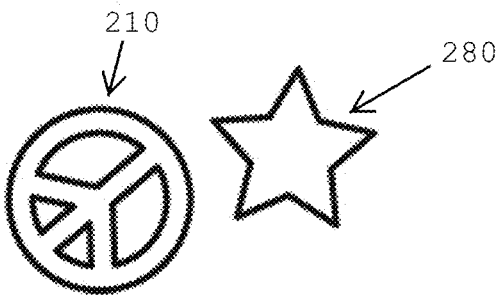
FIG. 2 is a representation of two rubbing templates.

FIG. 2 is a representation of a set of rubbing templates. By way of a non-limiting example, shown are two-dimensional representations of a peace sign 210 and a star 280. The star is an example of a solid shape, whereas the peace sign is an example of a partially solid shape, i.e., a shape in which there would be gaps or color showing between what has been removed after transfer through the abrasion described in this specification.

Figure 3:
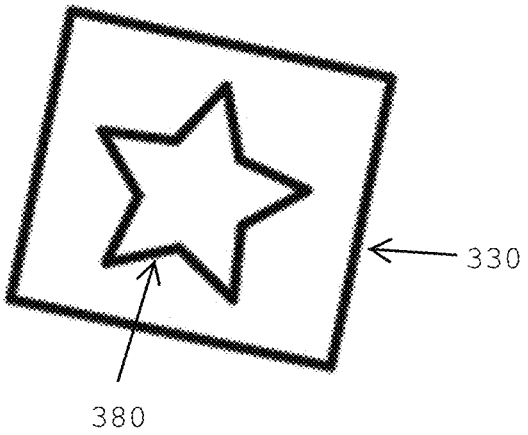
FIG. 3 is a representation of a rubbing template affixed to a mounting sheet.

FIG. 3 is a representation of a rubbing template in the form of a star 380 affixed to a mounting sheet 330. As with FIG. 2, for illustrative purposes, the representation is shown in two dimensions.

Figure 4:
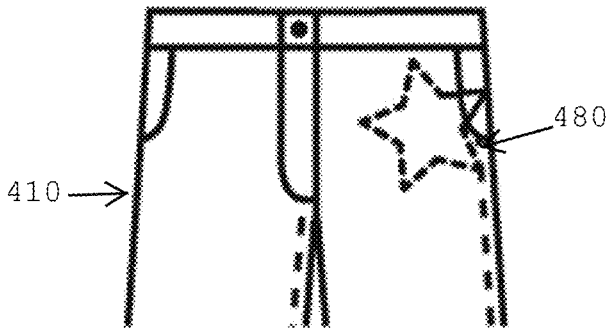
FIG. 4 is a representation of a rubbing template situated under a layer of a pair of jeans.

FIG. 4 is a representation of a rubbing template 480 situated under a layer of a pair of jeans 410. For illustrative purposes, the dotted lines are used to define the boundary of the star in order to represent that the shape is under the front side of the jeans.

Figure 5:
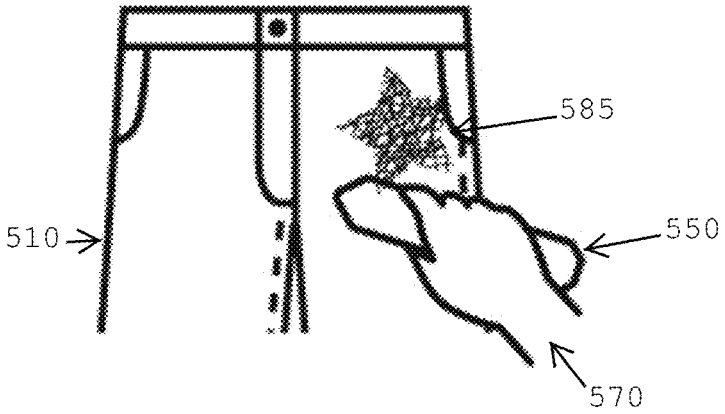
FIG. 5 is a representation of person using a rubbing tool in order to create a rub design.

FIG. 5 is a representation of person 570 using a rubbing tool 550 in order to create a rub design 585 on a pair of jeans 510. The underside of the rubbings tool contains the abrasive surface.

Figure 6:
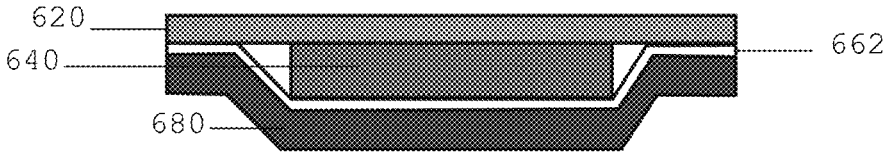
FIG. 6 is a representation of how the fabric, a rubbing template, and a mounting sheet may be oriented with a peel off adhesive in place to protect the mounting sheet prior to its use at a desired location.

FIG. 6 is a representation of how the fabric 620, a rubbing template 640, and a mounting sheet 680 may be oriented with a peel off adhesive 662 in place to protect the mounting sheet prior to its use at a desired location. By leaving the protective sheet in place until actual use of the adhesive surface of the mounting sheet, one can try out different positions of the rubbing template relative to the article before transferring a shape.

Various aspects of the present invention have been described for use in connection with one or more embodiments. However, unless explicitly stated or otherwise apparent from context, each feature described above in any one embodiment may be used in connection with any and all embodiments.

What is claimed is:

1. A method for color customization of an article of personal property, wherein the article comprises fabric that has a first region and a second region, wherein the first region has a first density of color element and the second region has a second density of color element, wherein the second density of color element is greater than the first density of color element and the first region is adjacent to the second region, said method comprising applying ink to the first region under conditions in which greater tension exists in the first region than in the second region and in which said ink causes a change in the color of the first region.

2. The method of claim 1, wherein the ink is not absorbed by the second region.

3. The method of claim 1, wherein the ink is absorbed by the second region in an amount that is less than the amount that the ink is absorbed by the first region.

4. The method of claim 1, wherein said applying comprises stamping the first region with an ink stamper.

5. The method of claim 1, wherein said applying comprises using an applicator, wherein said applicator is capable of transferring ink to said first region from an ink pad.

6. The method of claim 1, wherein said ink is a first ink and said article comprises a third region, wherein the third region is adjacent to the second region and has a third density of color element, wherein the second density of color element is greater than the third density of color element, and said method further comprises:

(a) creating tension over the third region; and (b) applying a second ink to the third region under conditions in which said ink is absorbed by the third region, wherein the first ink and the second ink are different colors.

7. The method of claim 6, wherein said applying of the first ink is by a first ink stamper and said applying of the second ink is by a second ink stamper.

8. The method of claim 6, wherein said applying of the first ink is by a first applicator and said applying of the second ink is by a second applicator.

9. The method claim 1 further comprising creating said first region in said article prior to step (a) by abrading said article.

10. The method of claim 9 further comprising applying heat to the first region after step (b).

11. The method claim 10, wherein said applying heat comprises application of an iron.

12. The method of claim 9, wherein said ink is fabric ink.

13. The method of claim 12, wherein said fabric is denim.

14. The method of claim 9, wherein said abrading comprises:

(a) affixing a rubbing template to a mounting sheet to form an affixed rubbing template, wherein the rubbing template has a front surface and a back surface, wherein the front surface defines a shape and the back surface has a surface area and wherein the mounting sheet comprises a first surface and a second surface, wherein the first surface comprises an adhesive material and the first surface has an area that is larger than the surface area of the back surface of the rubbing template;

(b) placing the affixed rubbing template adjacent to an inside surface of the article at a transfer location; and (c) rubbing an outside surface of the article at a location that corresponds to the transfer location, thereby removing color from the article and creating the first region.

15. The method according to claim 1 further comprising creating said first region in said article prior to step (a) by applying a laser to said article.

* * * * *